US006381778B1

(12) United States Patent
Peterson

(10) Patent No.: US 6,381,778 B1
(45) Date of Patent: May 7, 2002

(54) FITTED SHEET

(76) Inventor: Jennifer R. Peterson, P. O. Box 1142, Waitsfield, VT (US) 05673

( * ) Notice: Subject to any disclaimer, the term of this patent is extended or adjusted under 35 U.S.C. 154(b) by 0 days.

(21) Appl. No.: 09/480,410

(22) Filed: Jan. 11, 2000

(51) Int. Cl.[7] ..... A47G 9/04

(52) U.S. Cl. ..... 5/497; 5/484; 5/496; 5/499; 5/500; 5/502

(58) Field of Search ..... 5/484, 496, 497, 5/499, 500, 501, 502, 737, 738, 485, 699

(56) References Cited

U.S. PATENT DOCUMENTS

| | | | | | |
|---|---|---|---|---|---|
| 2,279,886 | A | * | 4/1942 | Fuchs | 5/738 |
| 2,907,055 | A | * | 10/1959 | Berman | 5/496 |
| 3,504,387 | A | * | 4/1970 | Hummel | 5/500 |
| 4,388,738 | A | * | 6/1983 | Wagner | 5/738 |
| 4,549,323 | A | * | 10/1985 | Brockhaus | 5/500 |
| 4,664,959 | A | | 5/1987 | Dagenais et al. | |
| 4,704,753 | A | | 11/1987 | Lunt | |
| 4,706,313 | A | * | 11/1987 | Murphy | 5/738 |
| 4,809,375 | A | | 3/1989 | Bull | |
| 4,899,408 | A | | 2/1990 | Illingworth | |
| 4,922,565 | A | | 5/1990 | Blake | |
| 5,249,320 | A | | 10/1993 | Moretz et al. | |
| 5,491,853 | A | | 2/1996 | Turnbull | |

OTHER PUBLICATIONS

NBC Dateline NBC Oct. 21, 1998 Transcript From Burrelle's Information Services.

* cited by examiner

*Primary Examiner*—Lynne H. Browne
*Assistant Examiner*—James M. Hewitt
(74) *Attorney, Agent, or Firm*—Joseph R. Birkner

(57) ABSTRACT

A fitted sheet, especially for use as a crib sheet for covering, for protecting a mattress and for completely and positively encasing and engaging the entire mattress such that a corner or any portion of the crib sheet can not be inadvertedly pulled loose by an infant and thereby significantly reducing the risk of an infant's chance of suffocation due to entanglement in the crib sheet. The fitted sheet includes a coverlet, generally conforming to the dimensions of the mattress, having a top panel spaced from and parallel to a bottom panel, a first end panel and a second end panel extending between the top and bottom panels and a first side panel and a second side panel extending between the top and bottom panels. The coverlet has a pad member formed of a liquid absorbent material, a base member formed of a liquid impermeable material, joined to a cover sheet, by sewing, to form an integral layered structure. The fitted sheet is releasably secured to the mattress with a zipper disposed on at least the first side panel, the first end panel and the second side panel of the coverlet. The fitted sheet may be reversibly usable when wet or soiled simply by reversing the mattress such that a clean, dry panel is available for immediate use without the need to change the entire fitted sheet until a later, more convenient, time.

13 Claims, 3 Drawing Sheets

FITTED SHEET

FIELD OF THE INVENTION

Figure 1:
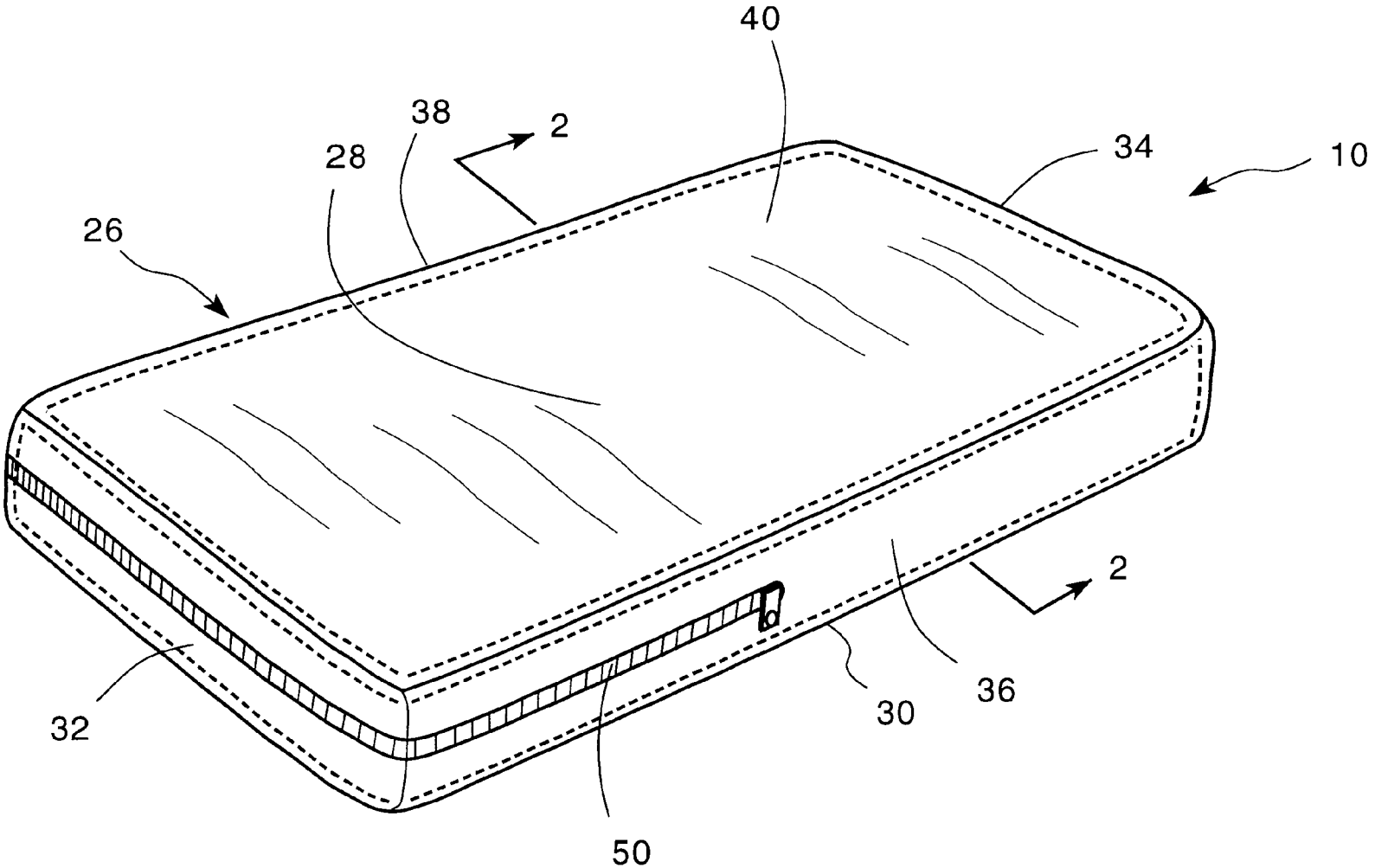

This invention relates generally to fitted sheets. More particularly, the present invention relates to a multi-purpose fitted sheet for use as a fitted crib or bed sheet with an integral protective structure for covering and for protecting a mattress and to a safe fitted sheet for use as a crib sheet that completely and positively encases and engages the entire mattress such that a corner or any portion of the crib sheet can not be inadvertedly pulled loose by an infant and thereby significantly reduces the risk of an infant's chance of suffocation due to entanglement in the crib sheet.

BACKGROUND OF THE INVENTION

Children's cribs are provided with a mattress which is protectively covered by a crib sheet. The usual practice is to position a separately disposed protective rubber mat or pad between the crib sheet and the mattress to maintain the surface of the mattress in a clean and sanitary condition when an infant or a young child occupying the crib wets or soils the crib sheet. Unfortunately, such rubber mats or pads are usually sized to fit under a portion of the top surface of the crib mattress and therefore do not adequately and completely protect the surfaces of the mattress left uncovered. Since the crib sheet is frequently soiled, it must be repeatedly washed, and the separate rubber mat must also be cleaned. The typical crib sheet is fabricated of cotton or other natural or synthetic textile material, or a composite thereof. In fitting the sheet to the mattress, one must manipulate the sheet and tuck it in to form corners which conform to the corners of the mattress. Frequently, the crib sheet does not completely encase the mattress, rather the crib sheet often only covers the sleeping surface, the sides and ends of the mattress and only a small portion of the bottom of the mattress, leaving the major bottom portion uncovered by the crib sheet. Oftentimes, even if some attachments such as elastic materials, hooks or the like are used to secure the mattress corners or edges by extending partially around the peripheral bottom edge mattress surface, children can undo the insecurely fastened crib sheet and become entangled in it and may suffocate.

Similar problems occur regarding maintaining ordinary bed sheets used in hospitals, nursing homes and in other situations in a clean and sanitary condition when the occupant of the bed is incontinent and wets or soils the sheet covering the mattress.

One problem associated with conventional crib sheets is that such sheets are permeable to liquid, and one must, therefore, after each use, strip the sheet off the mattress, often at inopportune times, and clean it for reuse.

Another problem associated with conventional crib sheets is that they are unsafe because they are partially disposed on the crib mattress are not adequately and positively secured to the crib mattress thereby allowing the crib sheet to be pulled off by an infant or child who can become entangled in it and suffocate.

U.S. Pat. No. 4,704,753 to Lunt, shows a fitted crib or bed sheet with a liquid impermeable backing plastic film with an absorbent top layer laminated to the film and being attachable to a mattress with elastic strips. A problem with such an arrangement is that elastic strips can weaken after repeated laundering and jeopardize their attachment effectiveness thereby making the potentially loosely secured sheet susceptible to unwanted removal by a child which can cause injury or death.

U.S. Pat. No. 4,899,408 to Illingworth shows a bedding system for a baby crib having a waterproof pad with elastic and Velcro mattress attachments. Elastic mattress attachments can deteriorate with repeated use and from laundering. The exposed bottom surface of the mattress does not permit the bedding system to be reversibly used.

U.S. Pat. No. 4,809,375 to Bull shows a mattress deck waterproof cover with a zipper(s); so that both the top and bottom mattress portions can be removed. The invention generally refers to a removable mattress cover or mattress pad which forms an integral portion of the mattress. It would not be practical for use as an integral fitted sheet.

U.S. Pat. No. 5,491,853 to Turnbull shows a fitted sheet with a zipper and elastic bands. The zipper is used to secure the bottom panel to the opposite side panel to hold the sheet to the mattress. The elastic bands are used to hold a portion of the sheet on a part of the bottom of the mattress. Elastic mattress attachments can deteriorate with repeated use and from laundering. The, exposed bottom surface of the mattress does not permit the fitted sheet to be reversibly used.

Other patents showing moisture proof sheets or the like includes U.S. Pat. No. 5,249,320 to Mortez et al which shows a spot welded moisture managing bed pad and bed sheet. Also, U.S. Pat. No. 4,922,565 to Blake shows a separable moisture proof sheet and U.S. Pat. No. 4,664,959 to Dagenais et al shows a stitched absorbent bed pad.

A transcript from Burrelle's Information Services of the NBC TV show "Dateline NBC" of Oct. 21, 1998 highlights the tragic problem of infant deaths caused by ill fitting crib sheets which are pulled off the crib mattress by infants and small children who become entangled in them and die by suffocation caused by asphyxiation. This reportedly happened to a child who had somehow managed to pull his sheet up and then wrapped himself in it so tightly that it cut off his air supply and suffocated him to death. It was reported that most crib sheets fit the mattress to the point that they probably touch the bottom corners but do not go under the corners. This may be due to the fact that there are no present federal safety standards for crib sheets. The Good Housekeeping Institute staffers bought 22 name-brand crib sheets and subjected them to an industry-accepted laundry-type test for shrinkage and were very surprised to find that only 4 of the 22 sheets tested ended up holding their fit properly after repeated washings. The sheets that shrunk couldn't be wrapped around and they don't fit completely over the mattress. Technicians demonstrated that a poorly fitting sheet could be readily detached by a one year old infant with a force of as little as three pounds. Although some efforts reportedly have been made to eliminate the problem, it is apparent that no practical crib sheet is available which solves the problem satisfactorily and that there is an immediate need for a practical safe crib sheet.

In view of the above mentioned problems and limitations associated with conventional crib sheets or the like, it was recognized by the present inventor that there is a need for an improved fitted sheet, that has an integral protective structure, rather than a separate bed pad, and preferably, an integral structure disposed on the underside on at least the top panel of the fitted sheet, and preferably on at least both the top and bottom panels and even more preferably, on the. interior perimeter of the fitted sheet, for reversibly covering and for completely protecting a mattress from wetting by an infant or by incontinent persons.

Also, the present inventor recognized the unfulfilled need to provide a safe fitted sheet for use as a crib sheet that completely and positively encases and engages the entire mattress such that a corner or any portion of the crib sheet can not be inadvertedly pulled loose by an infant and thereby significantly reduces the risk of an infant's chance of suffocation due to entanglement in the crib sheet.

Accordingly, it becomes clear that there is a great need for a fitted sheet that has an integral pad, rather than a separate pad, for reversibly covering and for protecting a mattress from wetting by an infant or by incontinent persons and a safe fitted sheet for use as a crib sheet which overcomes the disadvantages of the prior art sheets and pads. Such a fitted sheet should be one that is easy to use, is readily launderable, is positively securable to a mattress and is economically manufactured.

SUMMARY OF THE INVENTION

It is therefore an object of this invention to provide a multi-purpose fitted sheet comprising a coverlet with an integral pad member, rather than using a separate; mat or bed pad, for covering and for protecting a mattress from wetting by an infant or by incontinent persons and also serving as a safe fitted sheet for use as a crib sheet which avoids the aforementioned problems of prior art devices.

It is also an object of this invention to provide a fitted sheet with a coverlet that is reversible when used for covering and for protecting a mattress from wetting by an infant or by incontinent persons and a safe fitted sheet for use as a crib sheet.

It is another object of the present invention to provide an improved fitted sheet for use as a crib sheet which provides a safe, convenient means for removably securing the crib sheet to a mattress such that a corner or any portion of the crib sheet can not be inadvertedly pulled loose by an infant and thereby significantly reduces the risk of an infant's chance of suffocation due to entanglements in the crib sheet.

It is a further object of this invention to provide a fitted sheet which may be manufactured from readily available materials by conventional manufacturing processes.

Another object of this invention to provide a fitted sheet that has a coverlet which is launderable, having a base sheet member formed of a liquid impermeable material, a pad member formed of a liquid absorbent material and a cover sheet member formed of a material chosen from the group consisting of cotton, flannel and wool which are joined, by sewing, to form an integral layered structure.

It is also an object of this invention to provide a fitted sheet that has, preferably, a pad member with a base sheet member integral with a cover sheet member disposed on at least two panels of the fitted sheet, and even more preferably, on all panels on the interior perimeter of the fitted sheet, that may be conveniently reversed when soiled or wet, simply by reversing the mattress: such that a clean, dry bottom panel is available for immediate use without the need to change the entire fitted sheet until a later more convenient time.

It is still a further object of this invention to provide a fitted sheet that is simple in design, simple to manufacture, low in cost and easy to use.

This invention results from the realization that there is a great need for a fitted sheet, particularly a fitted sheet with a coverlet that has an integral pad member and preferably, a pad member on at least each side of the fitted sheet for reversibly covering and for protecting a mattress from wetting by an infant or by incontinent persons and a safe fitted sheet for use as a crib sheet. The resulting invention provides a user the capability of conveniently being able to change a fitted sheet particularly when an infant or an incontinent person wets the bed by reversing the mattress such that a clean, dry fitted sheet surface is available so that the entire bedding does not have to be changed or laundered until a later, more convenient time. Also, the invention, when used as a crib sheet, provides peace of mind in knowing that the fitted sheet is safely secured to the crib mattress.

The above and the other objects are achieved in accordance with the present invention, which, according to a first aspect, provides a fitted sheet for receiving and for covering a mattress having a top surface, a bottom surface spaced from and parallel to the top surface, a first end surface and a second end surface extending between the top and bottom surfaces and a first side surface and a second side surface extending between the top and bottom surfaces. The fitted sheet comprising a coverlet, generally conforming to the dimensions of the mattress, having a top panel spaced from and parallel to a bottom panel, a first end panel and a second end panel extending between the top and bottom panels and a first side panel and a second side panel extending between the top and bottom panels. The coverlet completely encasing the mattress. The coverlet having a base sheet member, a pad member and a cover sheet member. The pad member disposed between the base sheet member and the cover sheet member. The pad member and the base sheet member are joined, by sewing, to at least the top panel of the cover sheet member such that the base sheet member contacting at least one surface of the mattress. A fastening means for releasably securing the fitted sheet to the mattress disposed on at least the first side panel, the first end panel and the second side panel of the coverlet.

The second aspect is a special case of the first aspect of this invention with additional features.

According to a second aspect of the invention, a fitted sheet for receiving and for covering a mattress is disclosed, comprising a coverlet, generally conforming to the dimensions of the mattress, having a bottom panel, a first end panel and a second end panel extending between the top and bottom panels and a first side panel and a second side panel extending between the top and bottom panels completely encasing the mattress. The coverlet having a base sheet member formed of a liquid impermeable material, a pad member formed of a liquid absorbent material and a cover sheet member formed of a material chosen from the group consisting of cotton, flannel and wool. The coverlet is launderable. The pad member disposed between the base sheet member and the cover sheet member. The pad member and the base sheet member being joined, by sewing, to at least the top panel of the cover sheet member such that the base sheet member contacting at least one surface of the mattress. A fastening means for releasably securing the fitted sheet to the mattress disposed on at least the first side panel, the first end panel and the second side panel of the coverlet.

The third aspect is a special case of the first aspect and second aspects of this invention with additional features.

According to a third aspect of the invention, disclosed is a fitted sheet for receiving and for covering a mattress. The fitted sheet comprising a coverlet, generally conforming to the dimensions of the mattress, having a bottom, panel, a first end panel and a second end panel extending between the top and bottom panels and a first side panel and a second side panel extending between the top and bottom panels completely encasing the mattress. The coverlet having a base sheet member formed of a liquid impermeable material, a pad member formed of a liquid absorbent material and a cover sheet member formed of a material chosen from the group consisting of cotton, flannel and wool. The base sheet is laminated to the pad member prior to joining to the cover sheet. The coverlet is launderable. The laminated base sheet and the pad member disposed beneath the cover sheet member. The laminated base sheet member and the pad member being joined, by sewing, to at least both the top panel and to the bottom panel of the cover sheet member such that the base sheet member contacting the top and bottom surfaces of the mattress making the fitted sheet reversibly usable when the coverlet is wet or soiled, by reversing the mattress such that the bottom panel of the coverlet being clean and dry, is available for immediate use, without the need to change the entire fitted sheet until a later, more convenient, time. A fastening means for releasably securing the fitted sheet to the mattress, such as a zipper, disposed on the first side panel about midway between the top panel and the bottom panel and extending from a point about midway between the first end panel and the second end panel completely across the first end panel and terminating on the second side panel at about midway between the top panel and the bottom panel and between the first end panel and the second end panel of the coverlet to allow the mattress to be conveniently received by the fitted sheet.

BRIEF. DESCRIPTION OF THE DRAWINGS

Figure 2:
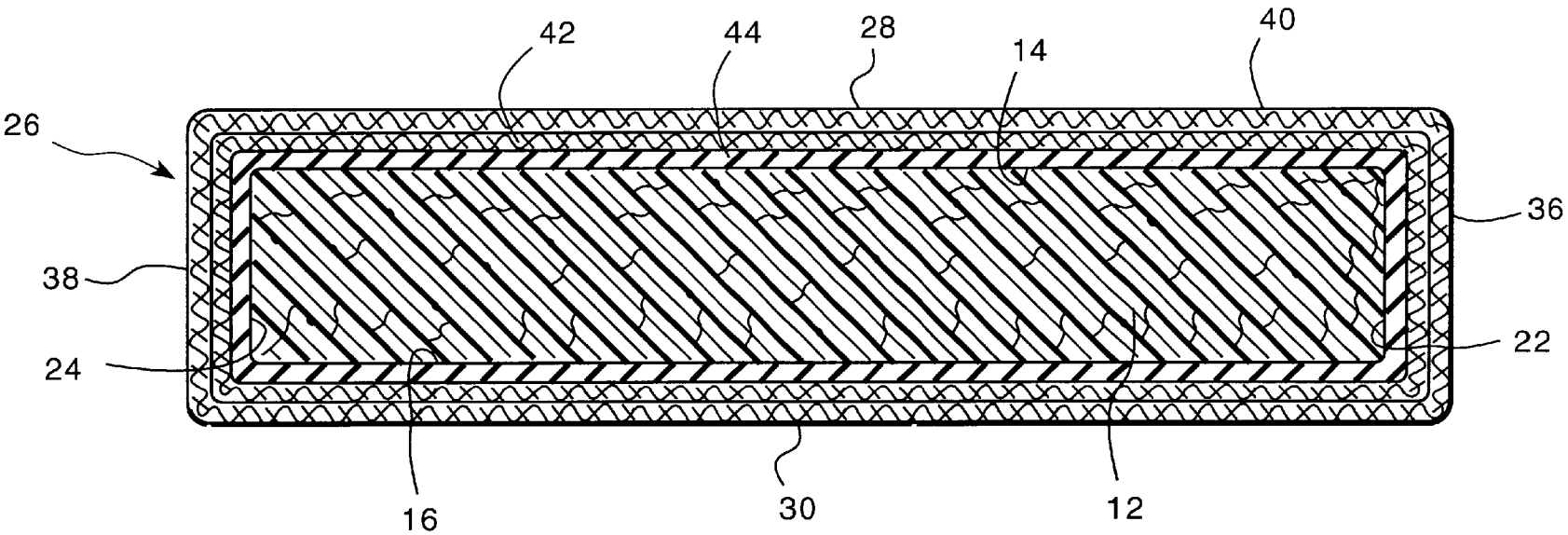
Figure 3:
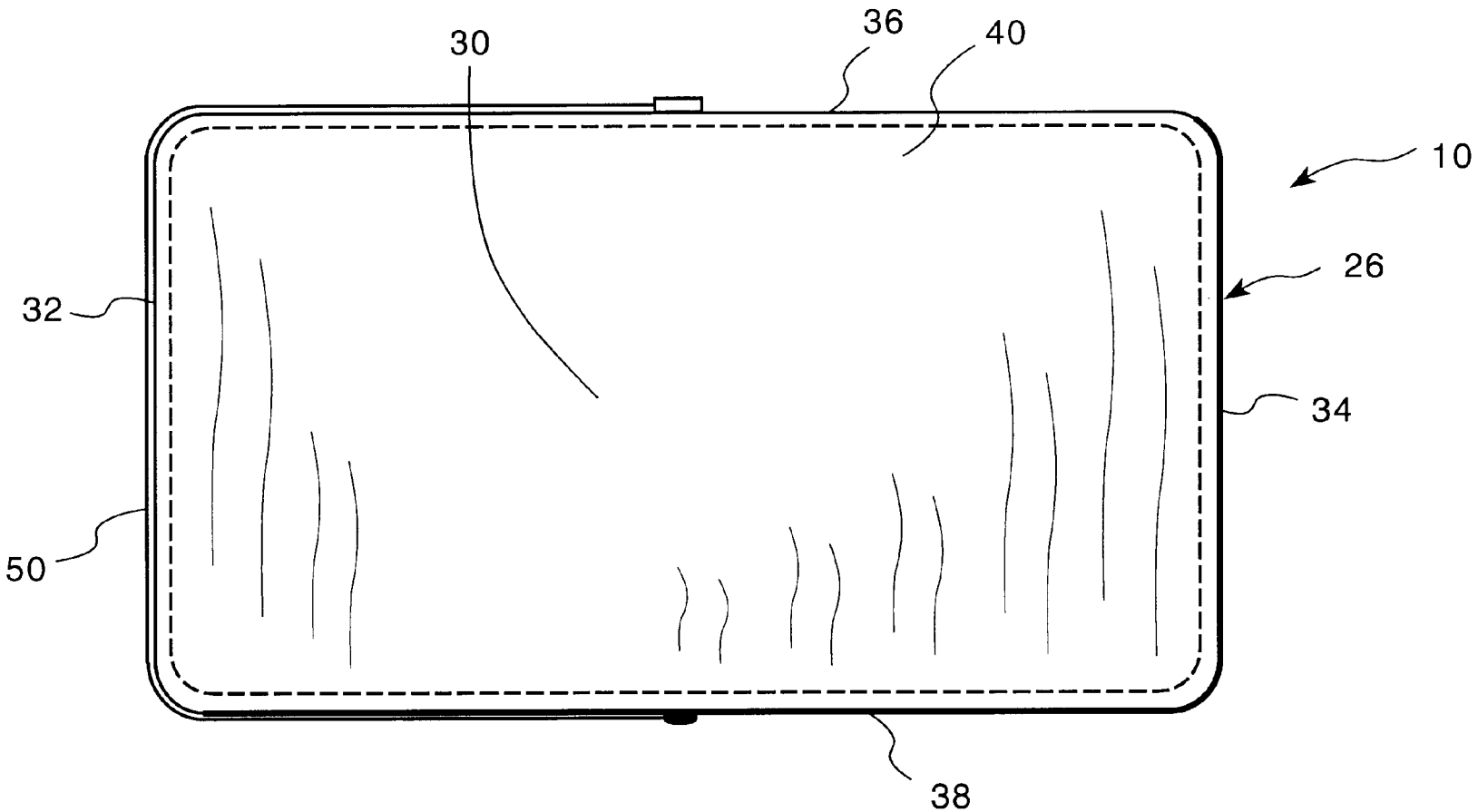

In the accompanying drawings:

FIG. 1 is a perspective view of a preferred embodiment of a fitted sheet of the instant invention attached to a mattress;

FIG. 2 which is a cross sectional view of a preferred embodiment of the fitted sheet of FIG. 1 taken along the line 2—2 showing the construction of the fitted sheet completely, protectively encompassing the mattress; and, FIG. 3 is a plan view of the bottom of the fitted sheet of FIG. 1.

DETAILED DESCRIPTION OF PREFERRED EMBODIMENTS

Looking more particularly to the drawings, there is shown in FIGS. 1–3 a preferred embodiment of a fitted sheet, which is generally indicated at 10, attached to a mattress 12 according to a preferred embodiment of the present invention.

Fitted sheet 10 is used for receiving and for covering the mattress 12, which has a top surface 14, a bottom surface 16 spaced from and parallel to the top surface 14, a first end surface (not shown) and a second end surface (not shown) extending between the top 14 and bottom surfaces 16 and a first side surface 22 and a second side surface 24 extending between the top 14 and bottom surfaces 16 as shown in FIG. 2.

Fitted sheet 10 essentially comprises a coverlet 26, which is launderable, generally conforming to the dimensions of the mattress 12, having a top panel 28 spaced from and parallel to a bottom panel 30, a first end panel 32 and a second end panel 34 extending between the top 28 and bottom panels 30 and a first side panel 36 and a second side panel 38 extending between the top 28 and bottom panels 30. The coverlet 26 completely encasing the mattress 12. The coverlet 26 having a base sheet member 44 formed of a liquid impermeable material, a pad member 42 formed of a liquid absorbent material and a cover sheet member 40 formed of a material chosen from the group consisting of cotton, flannel and wool. It is understood that the base sheet member 44, the pad member 42 and the cover sheet member 40 may be separate members which, when joined, form an integral layered structure. Preferably, for convenience, although not necessary to construct the coverlet 26, the pad member 42 may be laminated to the base sheet member 44 prior to joining to the cover sheet 40. As shown in FIG. 2, the pad member 42 is disposed between the base sheet member 44 and the cover sheet member 40. The base sheet member 44 and the pad member 42 being joined, by sewing, to at least both the top panel 28 and to the bottom panel 30 of the cover sheet member 40 such that the base sheet member 44 contacting the top 14 and bottom surfaces 16 of the mattress 12 making the fitted sheet 10 reversibly usable. A fastening means 50 for releasably securing the fitted sheet 10 to the mattress 12, such as a zipper is shown in FIG. 1 and in FIG. 3. The zipper is disposed on the first side panel 36 about midway between the top panel 28 and the bottom panel 30 and extending from a point about midway between the first end panel 32 and the second end panel 34 completely across the first end panel 32 and terminating on the second side panel 38 at about midway between the top panel 28 and the bottom panel 30 and between the first end panel 32 and the second end panel 34 of the coverlet 26 to allow the mattress 12 to be conveniently received by the fitted sheet 10 as shown in FIG. 3.

FIG. 2, shows a cross sectional view of a preferred embodiment of the fitted sheet 10 of FIG. 1 taken along the line 2-2 showing the construction of the fitted sheet 10. The pad member 42 and base sheet member 44 being attached to the cover sheet member 40 of the coverlet 26 and integral with the top 28 and bottom panels 30, side panels 36, 38 and end panels 32, 34 (not shown in FIG. 2) of the fitted sheet 10 making the fitted sheet 10 even more useful by completely, protectively, encompassing the mattress 12.

Preferably, the coverlet 26 of the fitted sheet 10 may be fabricated from readily available materials by conventional fabrication techniques such as by sewing as shown in FIG. 1 and in FIG. 3, as well as by weaving, laminating and material bonding methods. The cover sheet member 40 may be made from cotton, flannel, wool or other natural or synthetic fibers. The pad member 42 may be formed of a liquid absorbent material such as flannel, cotton, wool or other suitable natural or synthetic materials having good absorbent and wicking properties, while the base sheet member 44. may be formed of a liquid impermeable material such as plastic or rubber. The base sheet member 44 may also be formed of waterproof material. As mentioned, the base sheet member 44, the pad member 42 and the cover sheet member 40 may be separate members or preferably, the pad member 42 may be laminated, to the base sheet member 44 prior to joining to the cover sheet 40, which, when joined, by sewing, form an integral layered structure. The pad member 42 is disposed between the base sheet member 44 and the cover sheet member 40.

The pad member 42 and the base sheet member 44 are joined, by sewing, to form an integral layered structure, preferably to at least the top 28 and to the bottom panels 30 of the cover sheet member 40 to reversibly provide protection to both the top surface 14 and to the bottom surface 16 of the mattress 12. Furthermore, when the entire mattress 12 is encased with the fitted sheet 10 having the pad member 42 and the base sheet member 44 disposed on the interior perimeter of the cover sheet member 40, there is the added advantage of having all the surfaces of the mattress 12 protected by the coverlet 26 as shown in FIG. 2.

It is also understood that the pad member 42 and the base sheet member 44 may be joined, by sewing, to at least the top 28 of the cover sheet member 40to provide protection to the top surface 14 of the mattress 12. It is therefore appreciated that the fitted sheet 10 is readily adaptable to be manufactured in a variety of configurations to suit a particular application and consumer need without departing from this disclosure. Furthermore, the fitted sheet 10, may be made available in various sizes and may be readily adapted to fit a wide range of mattresses.

The fastening means 50 for releasably securing the fitted sheet 10 to the mattress 12 may be disposed on at least the first side panel 36, the first end panel 32 and the second side panel 38 of the coverlet 26 as shown in FIG. 1 and in FIG. 3. The fastening means 50 may comprise a zipper. The zipper is strategically disposed on the coverlet 26 by sewing and may, preferably, be disposed on at least the first side panel 36, the first end panel 32 and the second side panel 38 of the coverlet 26 as shown in FIG. 3. The zipper should extend enough so that the fitted sheet 10 can be conveniently received by and secured to the mattress 12. Also, the fastening means 50 may, alternately comprise a hook and loop fastener, buttons or other securing type of fasteners (not shown) in lieu of the zipper.

For use as a crib mattress covering, the fitted sheet 10 of the instant invention essentially avoids the need to install a separate underlayed mattress pad under the typical crib sheet. Such pads are often undersized and do not protect the mattress adequately form wetting or soiling and therefore the bed must be frequently changed by removing the sheet and the typical bed pad and then remaking the bedding. The fitted sheet 10 when constructed with the pad member 42 and the base sheet member 44 joined, by sewing, to form an integral layered structure, preferably to at least the top 28 and to the bottom panels 30 of the cover sheet member 40 to reversibly provide protection to both the top surface 14 and to the bottom surface 16 of the mattress 12 there is adequate protection to the top surface 14 of the mattress 12. The cover sheet member 40, completely encases the mattress 12. Also, when the entire mattress 12 is encased with the fitted sheet 10 having the pad member 42 and the base sheet member 44 disposed on the interior perimeter of the cover sheet member 40, there is the added advantage of having all the surfaces of the mattress 12 protected by the coverlet 26 as shown in FIG. 2. When a child wets or soils the fitted sheet 10 of the instant invention, the mattress 12 with the coverlet 26 attached thereto, may simply be reversed or flipped over such that the clean, dry bottom panel 30 of the coverlet 26 is available for immediate use without the need to change the entire fitted sheet 10 when it is wetted or soiled until a later, more convenient, time.

Surprisingly, the instant invention provides an added advantage and recognizes a problem and adequately and completely addresses an unfulfilled need, in that the fastening means 50 such as the zipper, allows the fitted sheet 10 to be used as a fitted crib sheet which provides a safe, convenient means for removably securing the crib sheet to the mattress 12 such that a corner or any portion of the crib sheet can not be inadvertedly pulled loose by an infant and thereby significantly reduces the risk of an infant's chance of suffocation due to entanglement in the crib sheet.

The fitted sheet 10 may be constructed in a wide variety of sizes and style variations and may also have artistic decorations thereon and may be adapted for use with other mattresses besides a crib mattress, and for use by incontinent persons beside children, without departing from the scope of this disclosure.

One practical advantage of the invention is that it provides an efficient, convenient, practical, safe, low cost, multipurpose and versatile fitted sheet 10 which completely covers, encases and protects the mattress 12, during use, and reduces the risk of an infant's chance of suffocation due to entanglement in the crib sheet.

Another advantage of the invention is that the fitted sheet 10, when wet or soiled, can be quickly changed simply by reversing the mattress 12 such that the clean, dry bottom panel 30 of the coverlet 26 is available for immediate use without the need to change the entire fitted sheet 10 until it is convenient to do so.

A further advantage of the invention is that the fitted sheet 10 is designed for ease of manufacture by standard methods and by using readily available materials.

Of course, a wide variety of further uses and advantages of the present invention will become apparent to one skilled in the art.

As disclosed, it is apparent that the instant invention can provide other covering, fastening and decorative options for use on various mattresses or structures and may be useful for incontinent persons or bedridden persons as for infants and small children. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A fitted sheet for receiving and for covering a mattress having a top surface, a bottom surface spaced from and parallel to the top surface, a first end surface and a second end surface extending between the top and bottom surfaces and a first side surface and a second side surface extending between the top and bottom surfaces, said fitted sheet comprising:

a coverlet, generally conforming to the dimensions of the mattress, said coverlet having a base sheet member formed of a liquid impermeable material, a pad member and a cover sheet member together defining a top panel spaced from and parallel to a bottom panel, a first end panel and a second end panel extending between said top and bottom panels and a first side panel and a second side panel extending between said top and bottom panels;

said coverlet completely encasing the mattress;

said pad member disposed between said base sheet member and said cover sheet member;

said pad member and said base sheet member joined, by sewing, to at least said top panel of said coverlet such that said base sheet member contacts at least one surface of the mattress;

fastening means for releasably securing said fitted sheet about the mattress; and, said fastening means disposed on at least said first side panel, said first end panel and said second side panel of said coverlet.

2. The fitted sheet of claim 1 wherein said pad member is formed of a liquid absorbent material.

3. The fitted sheet of claim 2 wherein said cover sheet is formed of a material chosen from the group consisting of cotton, flannel and wool.

4. The fitted sheet of claim 3 wherein said fastening means for releasably securing said fitted sheet about the mattress comprises a zipper disposed on, and extending about, said first side panel, said first end panel and said second side panel of said coverlet for a sufficient distance to permit convenient receipt of the mattress.

5. The fitted sheet of claim 4 wherein said coverlet is launderable.

6. The fitted sheet of claim 5 wherein said base sheet member and said pad member are disposed on at least both said top panel and on said bottom panel of said coverlet such that said base sheet member contacts the top and bottom surfaces of the mattress.

7. The fitted sheet of claim 5 wherein said base sheet member and said pad member are disposed on an interior perimeter of said cover sheet member such that said base sheet member contacts each of the surfaces of the mattress.

8. The fitted sheet of claim 5 wherein said base sheet is laminated to said pad member.

9. The fitted sheet of claim 8 wherein said laminated base sheet member and said pad member are disposed on at least both said top panel and on said bottom panel of said coverlet such that said base sheet member contacts the top and bottom surfaces of the mattress.

10. The fitted sheet of claim 8 wherein said laminated base sheet member and said pad member disposed on an interior perimeter of said cover sheet member such that said base sheet member contacts each of the surfaces of the mattress.

11. The fitted sheet of claim 5 wherein said fastening means for releasably securing said fitted sheet about the mattress comprises a zipper disposed on, and extending about, said first side panel, said first end panel and said second side panel of said coverlet for a sufficient distance to permit convenient receipt of the mattress.

12. A fitted sheet for receiving and for covering a mattress having a top surface, a bottom surface spaced front and parallel to the top surface, a first end surface and a second end surface extending between the top and bottom surfaces and a first side surface and a second side surface extending between the top and bottom surfaces, said fitted sheet comprising:

coverlet, generally conforming to the dimensions of the mattress, said coverlet having a base sheet member formed of a liquid impermeable material, a pad member formed of a liquid absorbent material and a cover sheet member formed of a material chosen from the group consisting of cotton, flannel and wool, said members together defining a top panel spaced from and parallel to a bottom panel, a first end panel and a second end panel extending between said top and bottom panels and a first side panel and a second side panel extending between said top and bottom panels;

said coverlet completely encasing the mattress;

said base sheet is laminated to said pad member;

said coverlet is launderable;

said laminated base sheet and said pad member disposed beneath said cover sheet member;

said laminated base sheet member and said pad member are sewn to at least both said top panel and to said bottom panel of said coverlet such that said base sheet member contacts the top and bottom surfaces of the mattress making said fitted sheet reversibly usable, when said coverlet is wet or soiled, by reversing the mattress such that said bottom panel of said coverlet being clean and dry, is available for immediate use, without the need to change said fitted sheet until a later, more convenient, time; and, fastening means for releasably securing said fitted sheet to the mattress, wherein said fastening means comprises a zipper, disposed on said first side panel about midway between said top panel and said bottom panel and extending from a point about midway between said first end panel and said second end panel completely across said first end panel and terminating on said second side panel at about midway between said top panel and said bottom panel and between said first end panel and said second end panel of said coverlet to allow the mattress to be conveniently received by said fitted sheet.

13. The fitted sheet of claim 12 wherein said laminated base sheet member and said pad member are disposed on an interior perimeter of said cover sheet member such that said base sheet member contacts each of the surfaces of the mattress.

* * * * *